US010625913B2

(12) United States Patent
Acevedo

(10) Patent No.: US 10,625,913 B2
(45) Date of Patent: Apr. 21, 2020

(54) TAMPER-EVIDENT DOUBLE-LID FOR PACKAGING AND CONTAINERS

(71) Applicants: Daniel Acevedo, Envigado (CO); Maria Beatriz Cadavid, Copacabana (CO); Jorge Eliecer Cediel, Medellin (CO); LABINST S.A.S., Medellin (CO); Carlos Andres Roldan, Medellin (CO); Santiago Salazar, Medellin (CO); Juan Gonzalo Santa Maria, Medellin (CO)

(72) Inventor: Daniel Acevedo, Envigado (CO)

(73) Assignees: Daniel Acevedo, Envigado (CO); Maria Beatriz Cadavid, Copacabana (CO); Jorge Eliecer Cediel, Medellin (CO); Labinst S.A.S., Medellin (CO); Carlos Andres Roldan, Medellin (CO); Santiago Salazar, Medellin (CO); Juan Gonzalo Santa Maria, Medellin (CO)

( * ) Notice: Subject to any disclaimer, the term of this patent is extended or adjusted under 35 U.S.C. 154(b) by 0 days.

(21) Appl. No.: 15/776,413

(22) PCT Filed: Nov. 22, 2016

(86) PCT No.: PCT/IB2016/057036

§ 371 (c)(1),
(2) Date: May 16, 2018

(87) PCT Pub. No.: WO2017/089955

PCT Pub. Date: Jun. 1, 2017

(65) Prior Publication Data

US 2018/0312312 A1 Nov. 1, 2018

(30) Foreign Application Priority Data

Nov. 23, 2015 (CO) ..... 15279221

(51) Int. Cl.
*B65D 55/02* (2006.01)
*B65D 50/00* (2006.01)
*B65D 41/04* (2006.01)

(52) U.S. Cl.
CPC ..... *B65D 55/026* (2013.01); *B65D 41/04* (2013.01); *B65D 50/00* (2013.01)

(58) Field of Classification Search
CPC .. B65D 55/026; B65D 41/045; B65D 55/022; B65D 2101/0069; B65D 41/04; B65D 50/00

(Continued)

(56) References Cited

U.S. PATENT DOCUMENTS 3,004,684 A * 10/1961 Lightburn ..... G03B 21/64 206/389
4,440,306 A * 4/1984 Van Buskirk ..... B65D 55/02 215/230

(Continued)

OTHER PUBLICATIONS

International Search Report issued in corresponding International Patent Application No. PCT/IB2016/057036 (with English translation) dated May 5, 2017 (4 pages).

*Primary Examiner* — Ernesto A Grano
(74) *Attorney, Agent, or Firm* — Kilyk & Bowersox, P.L.L.C.

(57) ABSTRACT

The present invention is directed to a tampering/opening evidence mechanism to avoid the adulteration and reuse of packages, which corresponds to a device having a dual lid with a series of mechanisms that, when the user turns the lid to open the product, make the side surface thereof to be stained by an ink located therein. Thus, the mechanism of the invention stains with a permanent/indelible ink the inside of the dual lid, when it is rotated by the user for the first opening of the container, and wherein said movement allows both surface to be stained due to an element, such as a foam, (Continued)

being charged with ink which stains both surfaces with the rotation of the lid.

12 Claims, 8 Drawing Sheets

(58) Field of Classification Search
USPC ..... 215/230
See application file for complete search history.

(56) References Cited

U.S. PATENT DOCUMENTS 4,475,661 A * 10/1984 Griffin ..... B65D 55/066 206/459.5
4,480,760 A * 11/1984 Schonberger ..... B65D 55/066 215/230
4,502,605 A * 3/1985 Wloszczyna ..... B65D 55/066 215/203
4,519,515 A 5/1985 Schonberger
4,526,752 A * 7/1985 Perlman ..... B65D 55/026 116/207
4,576,297 A * 3/1986 Larson ..... B65D 55/066 215/250
4,601,404 A * 7/1986 Shivers ..... B65D 55/026 215/230
4,666,052 A * 5/1987 Ou-Yang ..... B65D 53/04 215/230
4,747,499 A * 5/1988 Gach ..... B65D 51/145 215/250
4,747,500 A * 5/1988 Gach ..... B65D 51/145 215/250
4,793,500 A * 12/1988 Harding ..... B65D 55/066 116/307
4,801,011 A * 1/1989 Desdoigts ..... A45C 11/38 206/389
4,872,570 A * 10/1989 Harding ..... B65D 55/066 215/230
4,928,837 A * 5/1990 Curiel ..... B65D 43/0212 215/230
4,984,700 A * 1/1991 Knickerbocker ..... B65D 51/18 215/204
4,986,429 A * 1/1991 Singleton, Jr. ..... B65D 41/62 206/459.1
5,018,632 A * 5/1991 Schmidt ..... B65D 55/026 215/230
5,035,341 A * 7/1991 Heilman ..... B65D 55/066 215/230
5,092,477 A * 3/1992 Johnson, Jr. ..... B65D 55/066 215/220
5,265,744 A 11/1993 Duty et al.
5,289,929 A * 3/1994 Heilman ..... B65D 55/026 116/279
5,474,194 A * 12/1995 Heilman ..... B65D 55/066 215/230
5,497,879 A * 3/1996 Kao ..... B65D 43/0218 206/389
5,592,766 A * 1/1997 Mygatt ..... B65D 51/245 40/307
D389,062 S * 1/1998 Ekkert ..... D9/453
5,839,592 A * 11/1998 Hayes ..... B32B 27/08 215/230
5,882,116 A * 3/1999 Backus ..... B65D 27/30 206/807
5,896,686 A * 4/1999 Howes ..... G09F 19/14 206/459.1
6,065,623 A * 5/2000 Hierzer ..... B65D 51/245 215/230
6,068,149 A * 5/2000 Telega ..... A61J 7/04 116/308
6,226,907 B1 * 5/2001 Conley ..... G03B 25/02 359/619
6,373,786 B1 * 4/2002 Kagan ..... B65D 79/02 368/10
6,394,293 B1 * 5/2002 Hierzer ..... B65D 51/245 206/459.5
6,450,355 B1 * 9/2002 Lowry ..... B65D 3/22 220/212
6,694,596 B2 * 2/2004 Hierzer ..... B65D 51/245 215/230
6,938,757 B2 * 9/2005 Eastman ..... B65D 55/026 206/219
7,457,039 B2 * 11/2008 Raymond ..... B44F 1/10 359/619
D750,314 S * 2/2016 Hobson ..... D26/118
10,011,408 B2 * 7/2018 Pucci ..... B65D 41/045
10,071,840 B2 * 9/2018 Roussy ..... B65D 51/245
10,195,890 B2 * 2/2019 Cote ..... G02B 3/0056
2002/0079281 A1 * 6/2002 Hierzer ..... B65D 51/245 215/230
2002/0085287 A1 * 7/2002 Egawa ..... G02B 3/005 359/619
2005/0066877 A1 * 3/2005 Smith ..... B67D 7/32 116/298
2006/0283749 A1 * 12/2006 Wolfe ..... B65D 75/36 206/462
2018/0053078 A1 * 2/2018 Lane ..... G06Q 10/08

* cited by examiner

TAMPER-EVIDENT DOUBLE-LID FOR PACKAGING AND CONTAINERS

This application is a National Stage Application of PCT/IB2016/057036, filed Nov. 22, 2016, which claims priority to Colombian Application No. 15279221, filed Nov. 23, 2015.

TECHNICAL FIELD

The present invention relates to a tampering/opening evidence mechanism to avoid the adulteration and reuse of packages, which corresponds to a device having a dual lid with a series of mechanisms that, when the user turns the lid to open the product, make the side surface thereof to be stained by an ink located therein. Thus, the mechanism of the invention is based on the principle that the ink is dispersed within the two lids and the consumer can see in real time if the lid comes from the manufacturing company and is completely original, or can also notice that it has not been used, wherein the invention has the characteristic that the ink is completely isolated from the product without altering the composition thereof.

In this regard, the mechanism of the present invention stains with a permanent/indelible ink the inside of the dual lid, when it is turned by the user for the first opening of the container, wherein the lid has an inner dual lid mechanism in which the outer lid turns relative to the inner one, and wherein said movement allows both surface to be stained due to an element, such as a foam, being charged with ink which stains both surfaces with the rotation of the lid.

In this sense, the mechanism of the present invention can be applied in the field of devices designed to contain all kind of products in the industry dedicated to the manufacture of packages for food, medicaments, alcoholic beverages, and, in general, products contained in plastic or glass containers or any other material.

BACKGROUND OF THE INVENTION

Currently, the consumption of alcoholic beverages is bound to the adulteration thereof, which allows unscrupulous people to counterfeit a plurality of beverages which are for human consumption by reusing containers, reducing the costs and putting in danger both health and life of human beings.

Many efforts have been performed in order to try to remediate such a problem and to avoid previously used bottles (containers) to arrive to the hands of counterfeiters in charge of re-packaging the beverages so as to present a counterfeit beverage as an original one. However, it has not been possible to achieve a convincing result and there are countries in which the percentage of adulterated beverages can be more than 50% of the total of the consumed beverages.

Although this problem can be mainly seen in containers for alcoholic beverages, it can also occur in other kind of products which are exposed to counterfeits, such as in the pharmaceutical industry and even in liquids that can be used at industrial or automobile level, wherein the counterfeiting or adulteration produces economic losses in the sector and causes irreparable damages in the article or product where they are used.

In this sense, there is a plurality of disclosures in the state of the art related to systems or devices focused on trying to evidence the opening/tampering of a container, attempting to provide a solution to this problem which affects all users.

One of such disclosures is found in document WO 2014199190, which is related to a system for preventing the tampering and re-packaging of containers of glass, plastic or other materials, wherein the system corresponds to a double wall device and a system that when turning the lid of the container, allows an inner ink container to be pressed which stains the system and thus, there is evidence of opening or tampering of the system.

However, the system defined in this anteriority presents a focus and scope different by evidencing the use through a capillary which is located inside a double wall in the neck of the bottle, not a double lid.

On the other hand, there is document WO 2014149726 which teaches a product or container having a use indicator, wherein the product contains a container coupled to at least one of the container or a closure such that, upon removal of the closure from the container or upon removal of product from within the container, a coloration of the product changes irreversibly to indicate to a user that the product has been used, wherein the material includes a plurality of microcapsules including a first reactive and a second plurality of microcapsules including a second reactive different to the first one, wherein said microcapsules break with the removal of the container closure and thus change color in the form of indication.

Nevertheless, this document presents the disadvantage that the ink is contained in a series of microcapsules which must be exploded or broken so the ink stains the container, but there may be cases in which the pressure is not enough or the breaking of the microcapsules is not successful and there is no evidence of prior opening and there may be adulteration.

In the same manner, in the state of the art the patent application WO 2005072941 can be found, which discloses a closure with a tampering visual indicator for a fluid container, namely, for liquor bottles, wherein the closure is provided with an opening attached at the free end of a bottle which axially extends from the body of the bottle along a longitudinal axis which matches with the closure center axis, said neck is provided with an outer surface comprising a lid, a tubular sleeve to open and close the inside of the bottle as a consequence of a threaded opening of the lid. The tampering or opening evidence is made through the rupture of a seal which corresponds to a capsule with walls which breaks after the first opening of the lid and contains a chemical agent which stains the wall.

Finally, we have document U.S. Pat. No. 4,511,052 which refers to a container assembly incorporating a tightly sealed chemical indicator from the environment, but exposed to atmosphere with the opening of the container assembly, wherein the indicator adapts to change its appearance, whether in color or granule or crystal shape, with the exposure to moisture or oxygen. Thus, the indicator is located whether inside the tightly sealed container, or sealed on a fragile envelop which is operatively associated to a container closure member and breaks with the opening, or attempt to open the container.

In this regard, from the information described in the above paragraphs it is evident that there is still a need in the state of the art to design and implement a closure mechanism or lid for containers having a double wall and further having inside therein some kind of device or system for staining the inner wall of the lid, but ensuring that the medium used to stain is adequate and there is no possibility of possible leaks inside the container. Similarly, it is required that the device does not need a high pressure so as to be able to activate the staining system and thus guaranteeing that there will always be staining of all the containers that have been previously opened or tampered.

BRIEF DESCRIPTION OF THE DRAWINGS

The relevant aspects and the advantages of the present invention will be better understood with relation to the following drawings in which.

DETAILED DESCRIPTION OF THE INVENTION

The present invention is directed to a double lid device for evidencing opening or tampering of a container, wherein said device corresponds to the lid of the container and is located on the upper part thereof, wherein the device corresponds to a plurality of inner seals in the lid of the container, allowing users to have a greater certainty about the contents of the container.

Figure 1A:
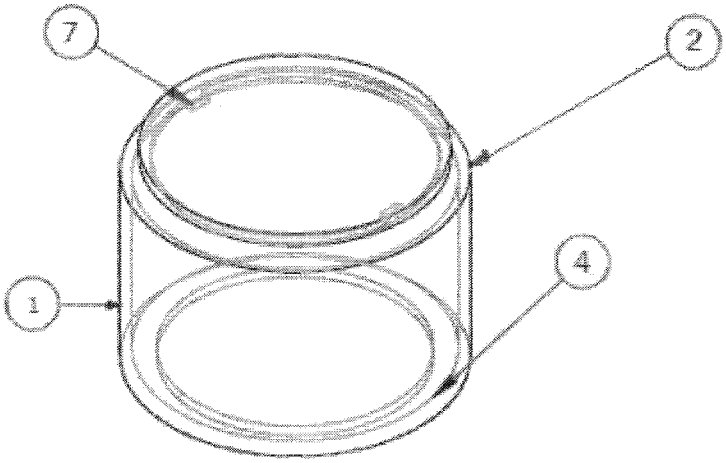
FIGS. 1A and 1B show a perspective view of the device of the present invention with an upper marking device.
Figure 1B:
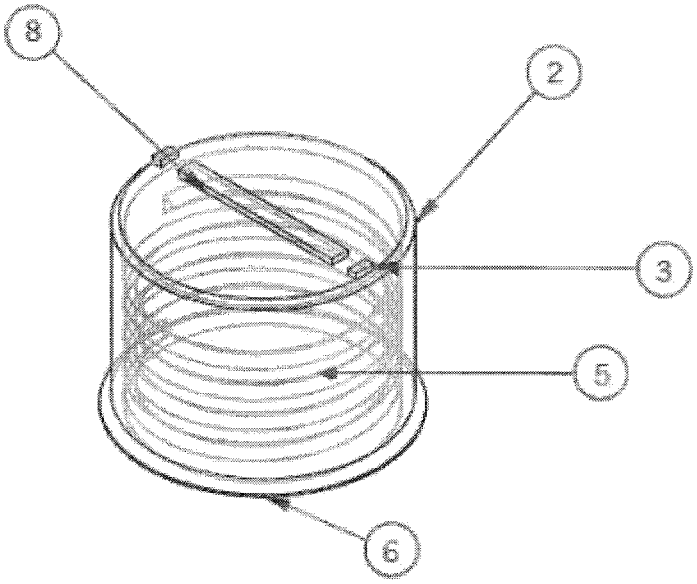
Figure 2:
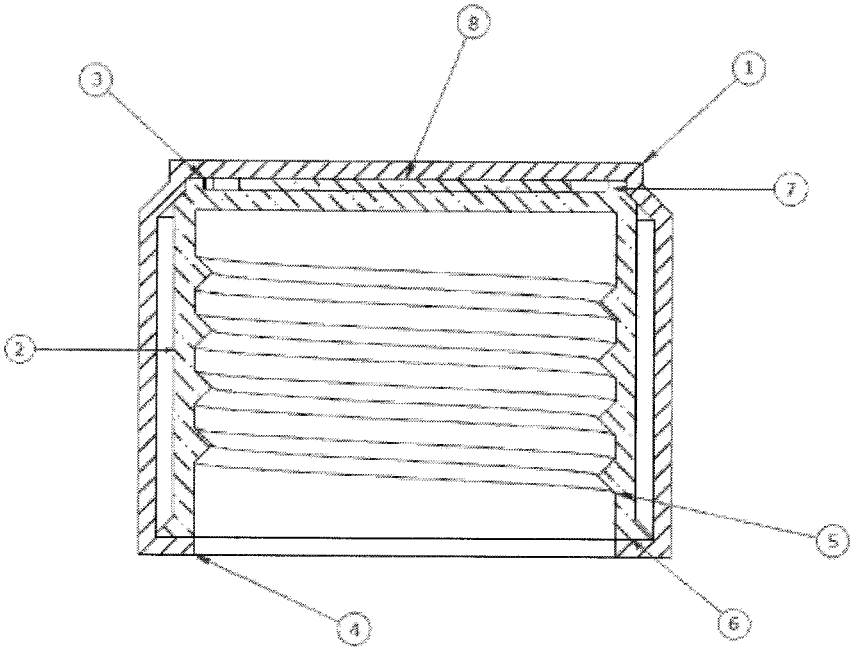
FIG. 2 shows a cross-section isometric view of the device of FIGS. 1A and 1B, which has an upper marking or staining element.

FIGS. 1A, 1B and 2 shows a double lid with only one marking or staining device. The device of the present invention comprises an outer lid (1) which is coupled to another inner lid (2), wherein both pieces couple to each other through an internal wedge (6) and an outer wedge (4). These wedges (6, 4) allow the outer lid (1) to rotate relative to the inner lid (2) but without being decoupled, in the same way in the upper space of the two lids an inner anti-twist stop (3) and an outer anti-twist stop (7) are located.

Thus, firstly there is the outer lid (1), which is preferably manufactured in a colorless or transparent plastic, in order to let the user see the functioning mechanism and the staining of the two lids when the container has been already tampered or opened.

In the lower part of the outer lid (1) there are some anti-twist stops (3, 7), in the same way an outer wedge (4) is fixed which is coupled to the inner lid (2) allowing it to be rotated relative to the outer lid (1) without being decoupled.

The inner lid (2) is a tubular piece comprising the following parts defined as: a thread (5) which coupled to the package, a lower wedge (6) and an outer wedge (4) which are coupled to avoid the involuntary movement of the device, a foam (8) charged with ink which rotates with the inner lid (2) when opening, generating thereby an indelible ink stain in the outer lid (1), in the same way on the inner surface we find an inner anti-twist stop (3) which is coupled to the outer anti-twist stop (7) after the rotation necessary to stain the outer lid (1), preventing the outer lid (1) to keep rotating along with the inner lid (2), allowing the thread (5) to rotate and the product to be opened.

In another embodiment of the present invention, the foam (8) charged with ink is laterally located, such that a side ink stain is achieved once the outer lid (1) is rotated with respect to the inner lid (2), i.e. in the side walls of the outer lid (1).

Figure 4:
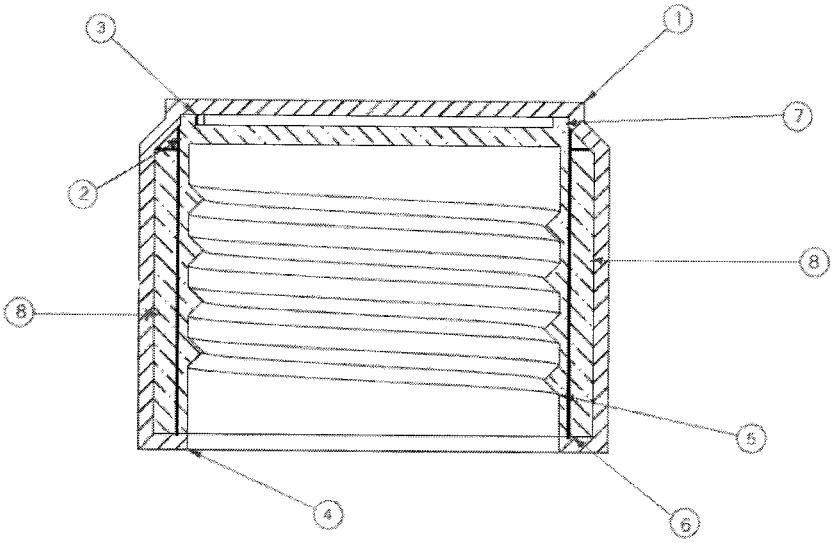
FIG. 4 shows a cross-section isometric view of the device of FIGS. 3A and 3B, which has a side marking or staining element.

FIG. 4 shows the diagram of the second embodiment, which basically comprises the same elements as previously mentioned, but with the difference that one the side surface of the inner lid (2) the foam (8) charged with indelible ink is located, instead of being in the upper part. However, other locations can be used in places where the structure allows to do so, wherein the presence of the foam (8) charged with side ink makes it necessary that the double lid mechanism is replicated for this new embodiment.

Figure 3A:
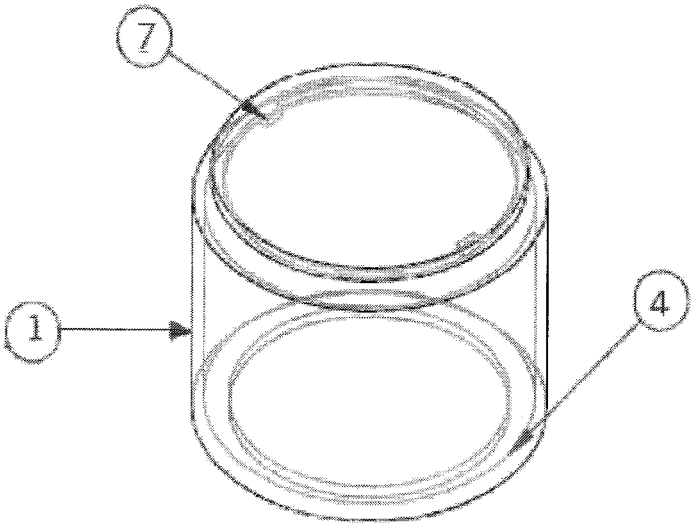
FIGS. 3A and 3B show a perspective view of the device of the present invention with a side marking device.
Figure 3B:
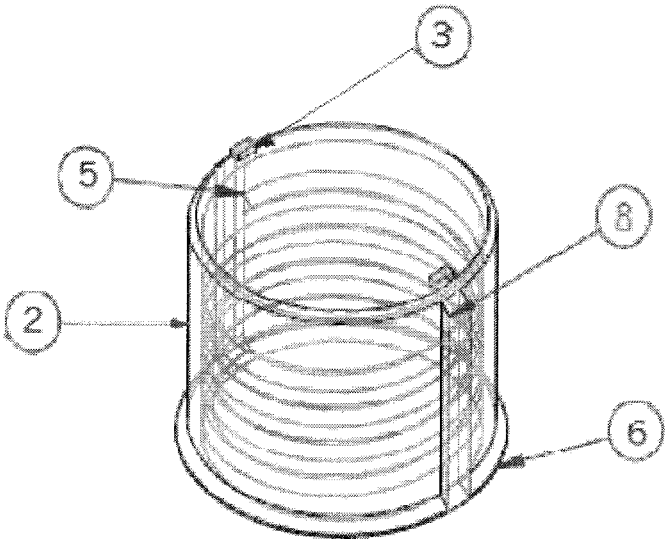

For this, FIGS. 3A and 3B show that on the sides of the inner lid (2) surface, the foams (8) charged with ink are disposed, wherein in this embodiment the outer lid (1) remains unchanged as well as the anti-twist stops (3, 7) and the wedges (4, 6).

In another embodiment of the invention, the staining covers simultaneously the upper and side surfaces.

Figure 5A:
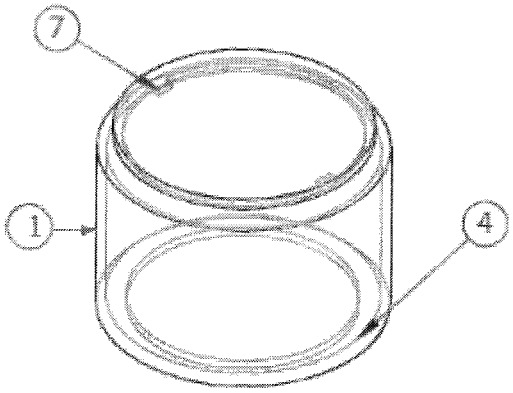
FIGS. 5A and 5B show a perspective view of the device of the present invention with a joint marking device.
Figure 5B:
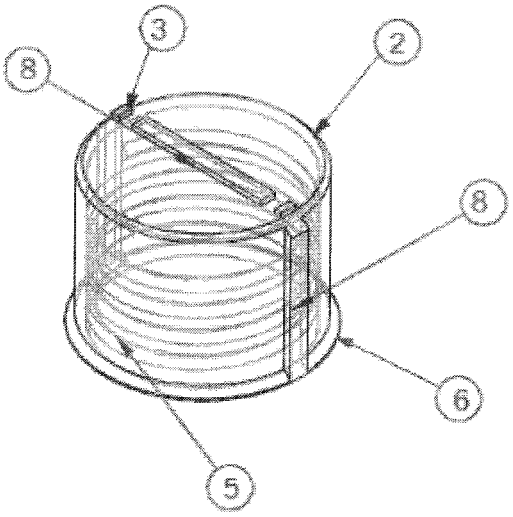
Figure 6:
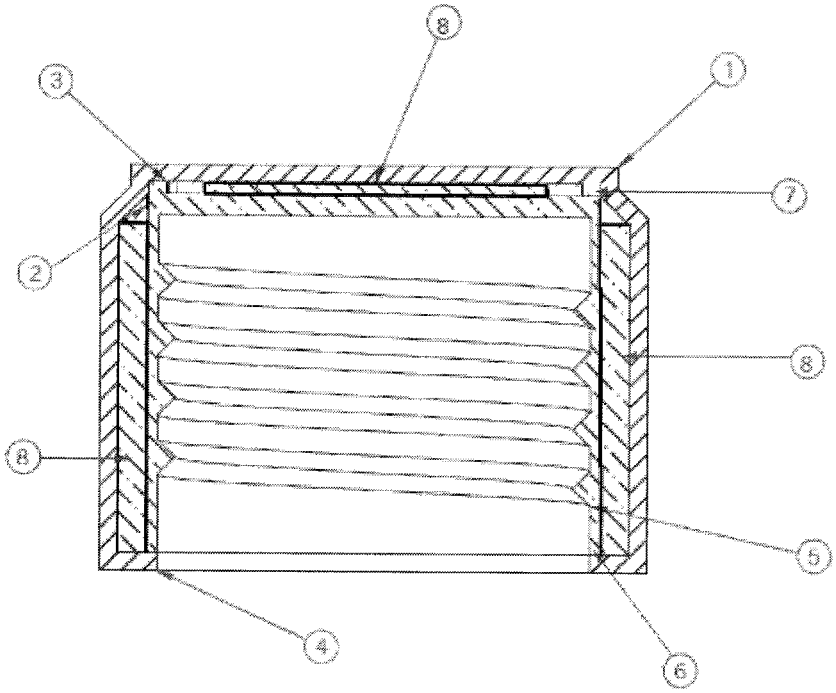
FIG. 6 shows a cross-section isometric view of the device of FIGS. 5A and 5B, which has a joint marking element.

FIGS. 5A and 5B show the inner lid (2) with several foams (8) charged with ink located both in the side walls and the upper wall of the inner lid (2), wherein in this case the outer lid (2) is impregnated with ink in the side walls and the upper wall once the outer lid (1) is rotated. The mechanism impregnating both surfaces is similar to the mechanism used in the previous embodiments as can be appreciated in FIGS. 5A and 5B, wherein the outer lid (1), the wedges (4, 6), the stop (3) and the stop (7) remain unchanged. The difference of this embodiment is based on that once the outer lid (1) is rotated, the foams (8) charged with ink impregnate simultaneously the side and surface walls of the outer lid (1).

Figure 8:
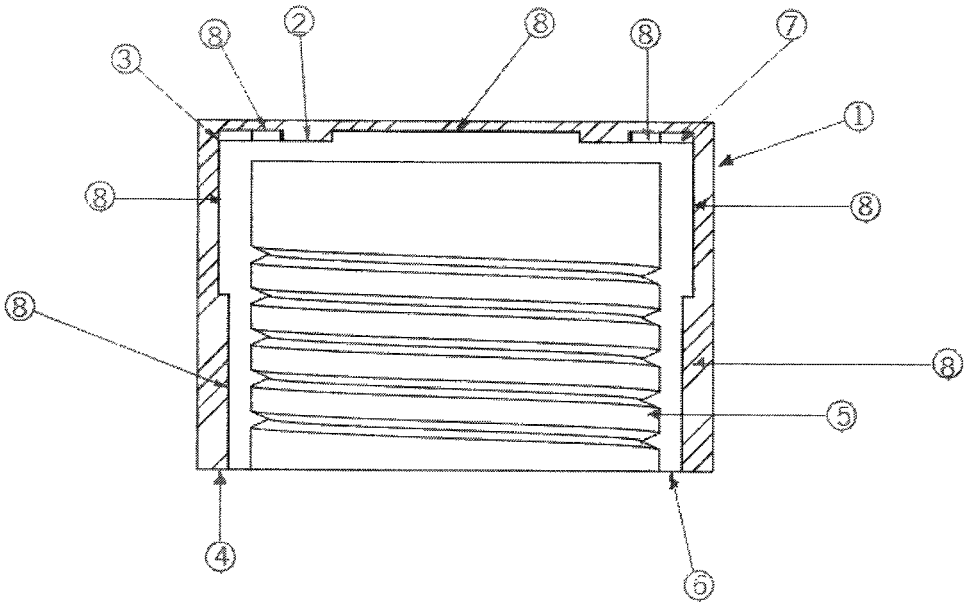
FIG. 8 shows a cross-section isometric view of the device of FIGS. 7A and 7B, which has a joint marking element which completely marks the outer and inner lids.

In another embodiment, the device of the present invention has the foam (8) charged with ink in the outer (1) and inner (2) lids, for example FIG. 8 shows the outer lid (1) with the foams (8) charged with ink in the upper and side walls, similarly in the inner lid (2) there are foams (8) charged with ink in its upper and side parts. In this case, the outer (1) and inner (2) lids are impregnated with ink in the surfaces once the outer lid (1) is rotated relative to the inner lid (2).

Figure 7A:
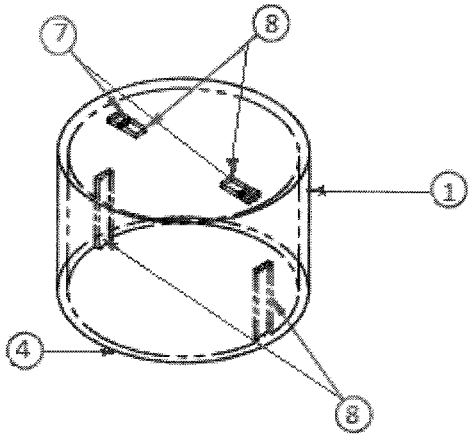
FIGS. 7A and 7B show a perspective view of the device of the present invention with a marking device in outer and inner lids.
Figure 7B:
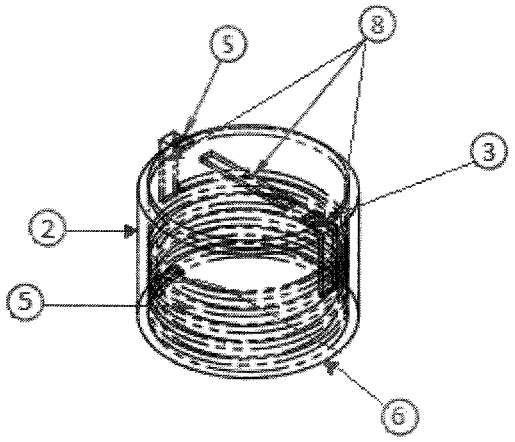

Thus, the side and upper staining mechanism is similar to the mechanism previously used as can be appreciated in FIGS. 7A and 7B, wherein the outer lid (1), the inner lid (2), the wedge (4), the wedge (6), the stop (3) and the stop (7) remain unchanged. The difference of this embodiment is based on that once the outer lid (1) is rotated relative to the inner lid (2), the foams (8) charged with ink impregnate the side and upper surfaces of the inner lid (1) and the outer lid (2).

The invention claimed is:

1. A double lid device for evidencing opening or tampering of a container and corresponding to the lid of the container located on top thereof, said device characterized by comprising:

an inner lid;

an outer lid configured to rotate relative to the inner lid;

an outer wedge and an inner wedge, which couple the outer lid and the inner lid, respectively;

an internal anti-twist stop located on the top surface of the inner lid;

an external anti-twist stop located on the internal surface of the outer lid and configured to couple to the internal anti-twist stop; and one or more staining elements located on the top surface and/or the side wall of the inner lid and directly contacting the inner top surface of the outer lid so as to stain such inner top surface when the outer lid is rotated, wherein the one or more staining elements contains or contain, or is or are impregnated with, an indelible ink.

2. The device of claim 1, wherein the outer lid is manufactured in a colorless or transparent plastic material.

3. The device of claim 1, wherein the inner lid is a tubular piece comprising a thread, the inner wedge, the one or more staining elements, and the internal anti-twist stop.

4. The device of claim 1, wherein the one or more staining elements comprises or comprise a foam or absorbent material charged with ink.

5. The device of claim 1, wherein the one or more staining elements is or are located in an upper part of an outer face of the inner lid.

6. The device of claim 1, wherein the one or more staining elements is or are located in side walls of an outer face of the inner lid.

7. The device of claim 1, wherein the one or more staining elements is or are located in an upper part and side walls of an outer face of the inner lid.

8. The device of claim 1, wherein the one or more staining elements is or are located both in an outer face of the inner lid and an inner face of the outer lid.

9. The device of claim 4, wherein the one or more staining elements is or are located in an upper part of an outer face of the inner lid.

10. The device of claim 4, wherein the one or more staining elements is or are located in side walls of an outer face of the inner lid.

11. The device of claim 4, wherein the one or more staining elements is or are located in an upper part and side walls of an outer face of the inner lid.

12. The device of claim 4, wherein the one or more staining elements is or are located both in an outer face of the inner lid and an inner face of the outer lid.

* * * * *